US009010413B2

(12) United States Patent
Artherholt et al.

(10) Patent No.: US 9,010,413 B2
(45) Date of Patent: Apr. 21, 2015

(54) BALL DROP WELLHEAD CONTROL APPARATUS

(71) Applicant: Oil States Energy Services, LLC, Houston, TX (US)

(72) Inventors: Danny Lee Artherholt, Asher, OK (US); Bob McGuire, Meridian, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 177 days.

(21) Appl. No.: 13/720,040

(22) Filed: Dec. 19, 2012

(65) Prior Publication Data

US 2014/0166265 A1 Jun. 19, 2014

(51) Int. Cl.
*E21B 43/12* (2006.01)
*F16L 55/46* (2006.01)

(52) U.S. Cl.
CPC ..... *E21B 43/12* (2013.01)

(58) Field of Classification Search
USPC ..... 166/193, 318, 70, 75.15, 284; 137/15.07, 625.46, 625.47; 15/104.062
See application file for complete search history.

(56) References Cited

U.S. PATENT DOCUMENTS 3,039,531 A * 6/1962 Scott ..... 166/70
3,445,087 A 5/1969 Priese et al.
3,894,718 A 7/1975 Koch et al.
4,099,705 A * 7/1978 Runyan ..... 251/171
4,111,229 A * 9/1978 Christian ..... 137/614.17
4,231,545 A 11/1980 Nelimarkka
4,460,157 A 7/1984 Marchal
4,467,823 A 8/1984 Shaffer et al.
4,577,830 A 3/1986 Winegeart
4,605,202 A 8/1986 Tsuno et al.
4,934,656 A 6/1990 Groves et al.
5,154,395 A 10/1992 Horvei
5,494,256 A 2/1996 Beson
6,253,791 B1 7/2001 Miklo

OTHER PUBLICATIONS

For the American Heritage Dictionary definition: align. (n.d.) The American Heritage® Dictionary of the English Language, Fourth Edition. (2003). Retrieved Aug. 8, 2014 from http://www.thefreedictionary.com/align.*
For the American Heritage Dictionary definition: right. (n.d.) The American Heritage® Dictionary of the English Language, Fourth Edition. (2003). Retrieved Aug. 8, 2014 from http://www.thefreedictionary.com/right.*

* cited by examiner

*Primary Examiner* — David Andrews
*Assistant Examiner* — Wei Wang
(74) *Attorney, Agent, or Firm* — Nelson Mullins Riley & Scarborough, LLP

(57) ABSTRACT

A ball drop wellhead control apparatus provides a control ball between one of a frac ball drop and a frac ball injector used to drop frac balls into a frac fluid stream being pumped into a subterranean well to ensure that only frac balls intended to be dropped reach the frac fluid stream.

16 Claims, 10 Drawing Sheets

BALL DROP WELLHEAD CONTROL APPARATUS

FIELD OF THE INVENTION

This invention relates in general to hydrocarbon well stimulation equipment and, in particular, to a ball drop wellhead control apparatus that provides a control gate between a frac ball drop or frac ball injector and a stimulation fluid stream that is being pumped into a hydrocarbon well.

BACKGROUND OF THE INVENTION

Current methods for completing hydrocarbon wells often involve pumping fracturing fluids into one or more production zones of a well. In order to improve efficiency of this process, ball-actuated frac sleeves were invented. The ball-actuated frac sleeve has side ports that block fluid access to a production zone with which it is associated until an appropriately sized frac ball is pumped down from the surface to open the sleeve. The frac ball lands on a seat in the ball-actuated frac sleeve and frac fluid pressure on the frac ball forces the side ports in the frac sleeve to open and provide fluid access to that production zone.

A frac ball dropped out of sequence is very undesirable because one or more zones are not fractured and the ball-actuated sleeves associated with those zones are left closed, so expensive remediation is required. A ball drop wellhead control apparatus that provides a control ball between a frac ball drop or frac ball injector and a stimulation fluid stream that is being pumped into a hydrocarbon well has been invented, as described in assignee's pending U.S. patent application Ser. No. 13/331,903 filed Dec. 20, 2011, the specification of which is incorporated herein by reference. However, a ball drop wellhead control apparatus that is less expensive to construct is desirable.

Therefore, there exists a need for a ball drop wellhead control apparatus that is less expensive to construct.

SUMMARY OF THE INVENTION

It is therefore an object of the invention to provide a ball drop wellhead control apparatus that provides a control ball between a frac ball drop or frac ball injector and a stimulation fluid stream that is being pumped into a hydrocarbon well.

The invention therefore provides a ball drop wellhead control apparatus, including: a control body having a central passage; a control ball housed by the control body and obstructing the central passage, the control ball having an inlet port aligned with the central passage in a ball catch position, a ball pocket and an outlet port, the control ball inhibiting any frac ball in the ball pocket from being released from the ball drop wellhead control apparatus until the control ball is rotated to a ball release position in which the outlet port is aligned with the central passage.

The invention further provides a ball drop wellhead control apparatus, including: a control body adapted to be mounted below a frac ball drop or a frac ball injector so that any frac balls released from the frac ball drop or the frac ball injector enter a central passage of the control body before the frac balls can enter a frac fluid stream being pumped into a well; and a control ball housed by the control body and obstructing the central passage of the control body, the control ball providing fluid communication between the fluid stream and the frac ball drop or the frac ball injector when the control ball is in a ball catch position, while inhibiting any frac ball dropped from the frac ball drop or the frac ball injector from being released from the central passage of the control body until the control ball is moved to a ball release position.

The invention yet further provides ball drop wellhead control apparatus, including: a control body adapted to be mounted in a frac stack below a frac ball drop or a frac ball injector such that all frac balls released from the frac ball drop or the frac ball injector enter an inlet bore of the control body; a control ball housed by the control body and obstructing a central passage of the control body, the control ball having an inlet port aligned with the central passage when the control ball is in a ball catch position and an outlet port that is aligned with the central passage when the control ball is in a ball release position; and an actuator stem connected to the control ball, the actuator stem being adapted to move the control ball from the ball catch position to the ball release position.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a ball drop wellhead control apparatus that permits an operator to verify that only a correct ball has been dropped from a ball drop or a ball injector before the ball is released into a fracturing fluid stream being pumped into a well. Consequently, any malfunction of the ball drop or ball injector or operator error that results in a ball being dropped out of sequence, or too many balls being dropped at one time, can be prevented from impacting downhole conditions. Thus, the cost of expensive remediation can be avoided.

Figure 1:
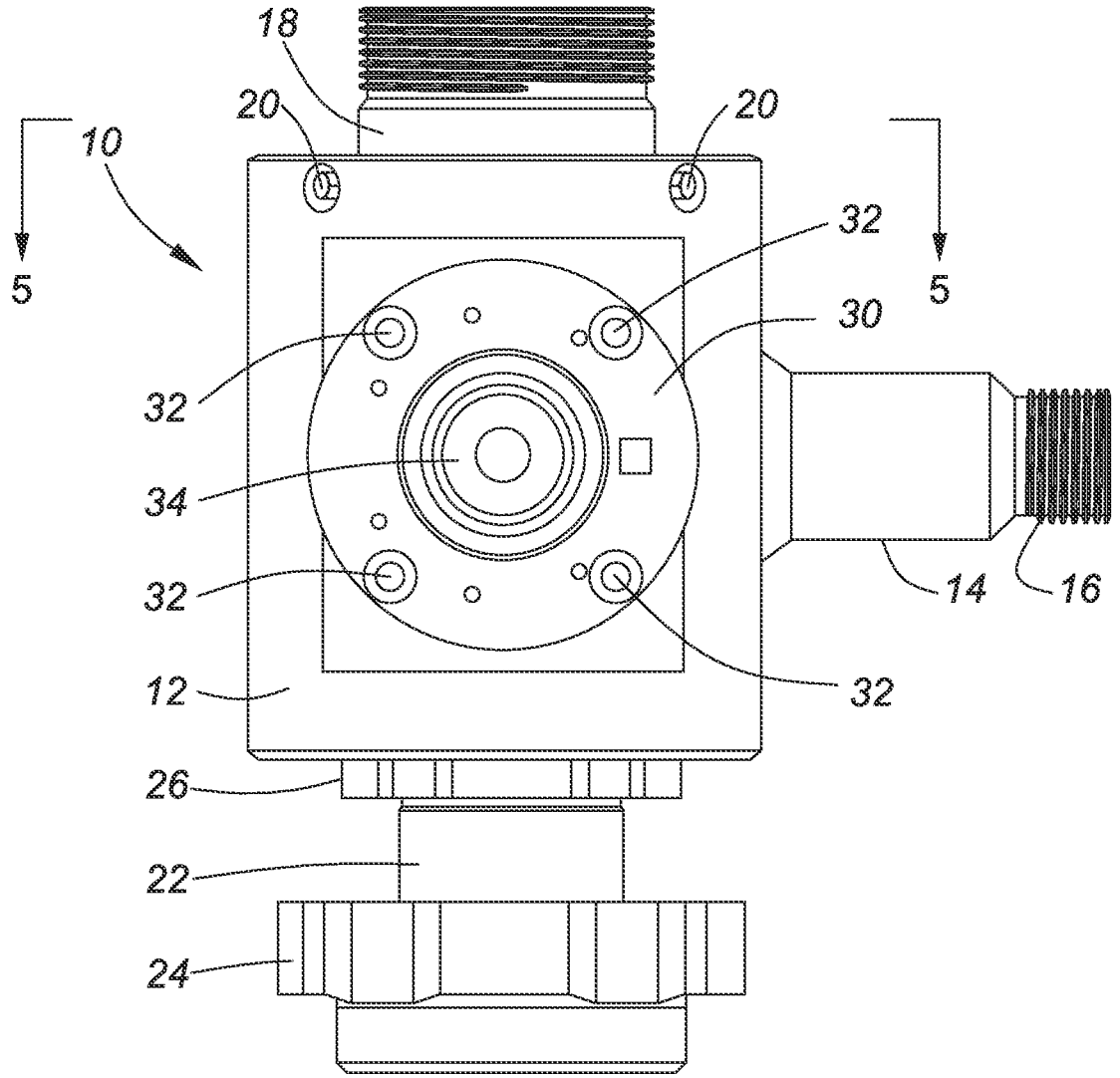
FIG. 1 is a schematic front elevational diagram of one embodiment of a ball drop wellhead control apparatus in accordance with the invention.

FIG. 1 is a schematic elevational diagram of one embodiment of the ball drop wellhead control apparatus 10 in accordance with the invention. The ball drop wellhead control apparatus 10, hereinafter referred to as control apparatus 10, includes a tubular control body 12 with an injection port 14 that terminates in an injection adapter 16. The injection adapter 16 permits the connection of a frac iron to the control apparatus to allow fracturing fluid to be pumped into the control apparatus 10 to permit a frac ball held by the control apparatus 10 to be pumped down into a fluid stream being injected into a well. This ensures that the frac ball is delivered into the fluid stream and is injected into the well.

This embodiment of the control apparatus 10 is provisioned with quick-disconnect threaded unions described in assignee's U.S. Pat. No. 7,484,776 which issued Feb. 3, 2009, the specification of which is incorporated herein by reference. A male component 18 of the threaded union is connected to a top of the control body 12 and locked in place by a plurality of set screws 20. The male component 18 is used to mount a ball drop, a ball injector or an adapter used to mount a ball drop or a ball injector to the control apparatus 10. A female component 22 of the threaded union is connected to a bottom end of the control body 12. The female component 22 supports a hammer nut 24, as explained in the assignee's above-referenced patent. A lock nut 26 inhibits rotation of the female component with respect to the control body 12. The female component 22 and the hammer nut 24 are used to connect the control apparatus 10 to a frac head or the like in a manner that is known in the art and shown below in FIG. 10.

Figure 10:
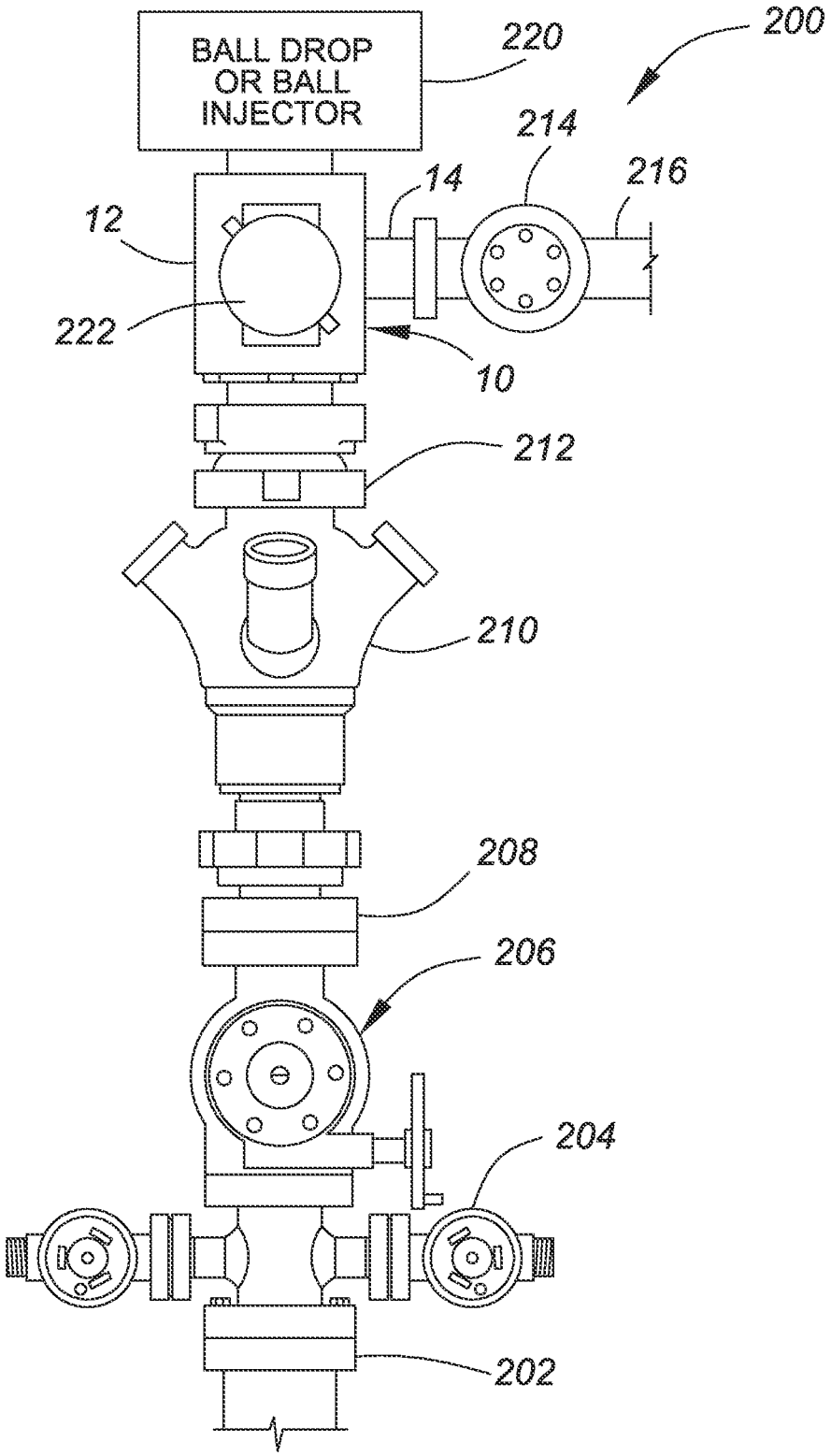
FIG. 10 is a schematic diagram of the control apparatus 10 shown in FIG. 1 incorporated in an exemplary frac stack that is mounted to a wellhead.

In this embodiment, the control apparatus 10 is operated using a hydraulic actuator shown in FIG. 10 that is mounted to the control body 12 by a mounting plate 30. The mounting plate is secured to the control body 12 by a plurality of connectors 32. An actuator stem 34 is connected to a ball control mechanism of the control apparatus 10, as will be explained below with reference to FIG. 7. The actuator stem 34 is turned 90° by an actuator to move a ball control mechanism from a ball catch position to a ball release position as will be explained below with reference to FIGS. 5-7.

Figure 2:
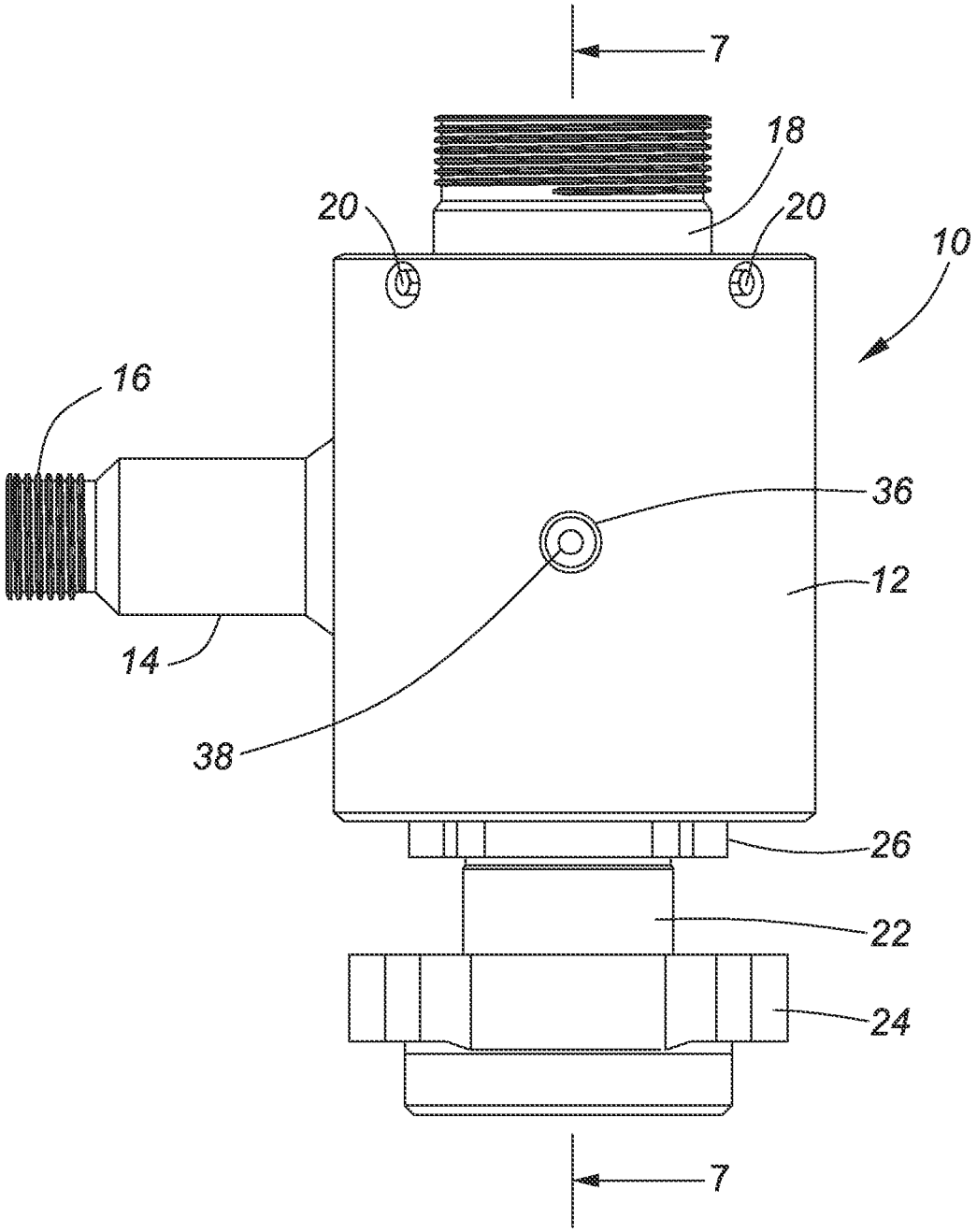
FIG. 2 is a schematic rear elevational diagram of the embodiment of the invention shown in FIG. 1.

FIG. 2 is a schematic rear elevational diagram of the embodiment of the control apparatus 10 shown in FIG. 1. A port in a rear side of the control body 12 supports a pressure balance stem 38 of the ball control mechanism, which will be explained below in more detail with reference to FIG. 7

Figure 3:
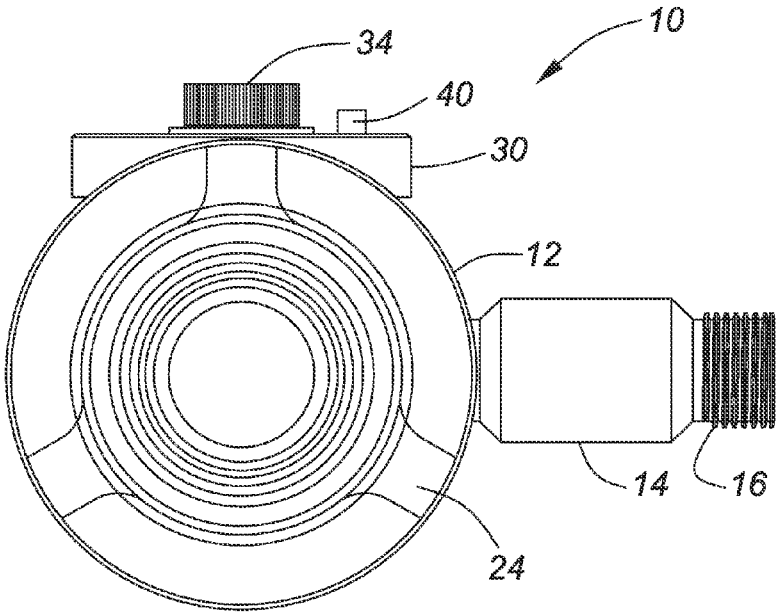
FIG. 3 is bottom plan view of the embodiment of the invention shown in FIG. 1.

FIG. 3 is a bottom plan view of the control apparatus 10 shown in FIG. 1. A lug 40 secured to the mounting plate 30 accurately aligns the hydraulic actuator to ensure that the ball control mechanism is moved from the ball catch to the ball release position and returned to the ball catch position, as will be explained below with reference to FIGS. 5-7.

Figure 4:
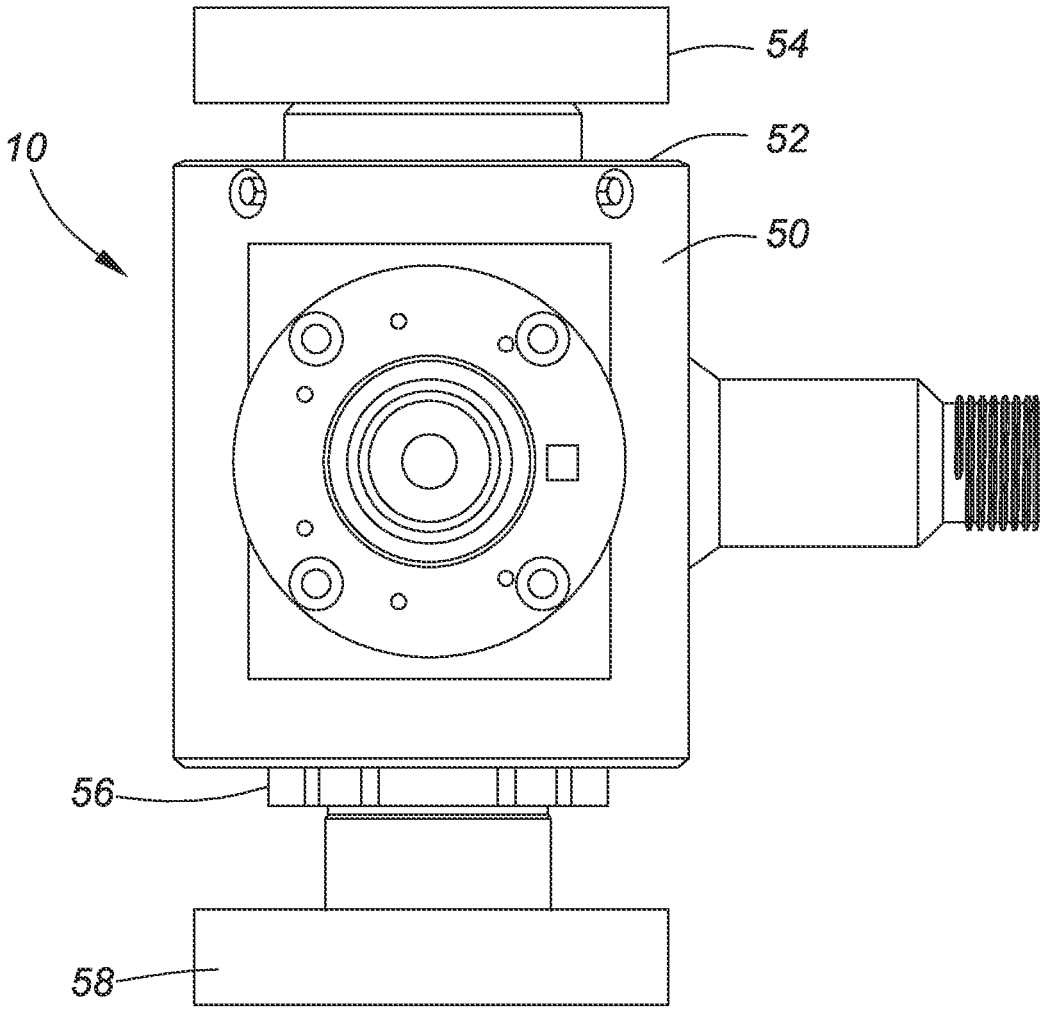
FIG. 4 is a schematic front elevational diagram of another embodiment of the ball drop wellhead control apparatus in accordance with the invention.

FIG. 4 is a side elevational view of another embodiment of a ball drop wellhead control apparatus 50 (hereinafter control apparatus 50) in accordance with the invention. The control apparatus 50 has a control body 52. A top end of the control body 52 terminates in an American Petroleum Institute (API) flange 54 used for a bolted connection to a frac ball drop or a frac ball injector (not shown) using flange bolts (not shown) in a manner well known in the art. A bottom end 56 of the control body 50 terminates in another API flange 58, also constructed in a manner well known in the art. It should be noted that the top end 52 and/or the bottom end 56 may alternatively be provisioned with an API stud pad (not shown) that is equally well known to those skilled in the art. In all other respects the control body is identical to the control body 10 described above with reference to FIG. 1.

Figure 5:
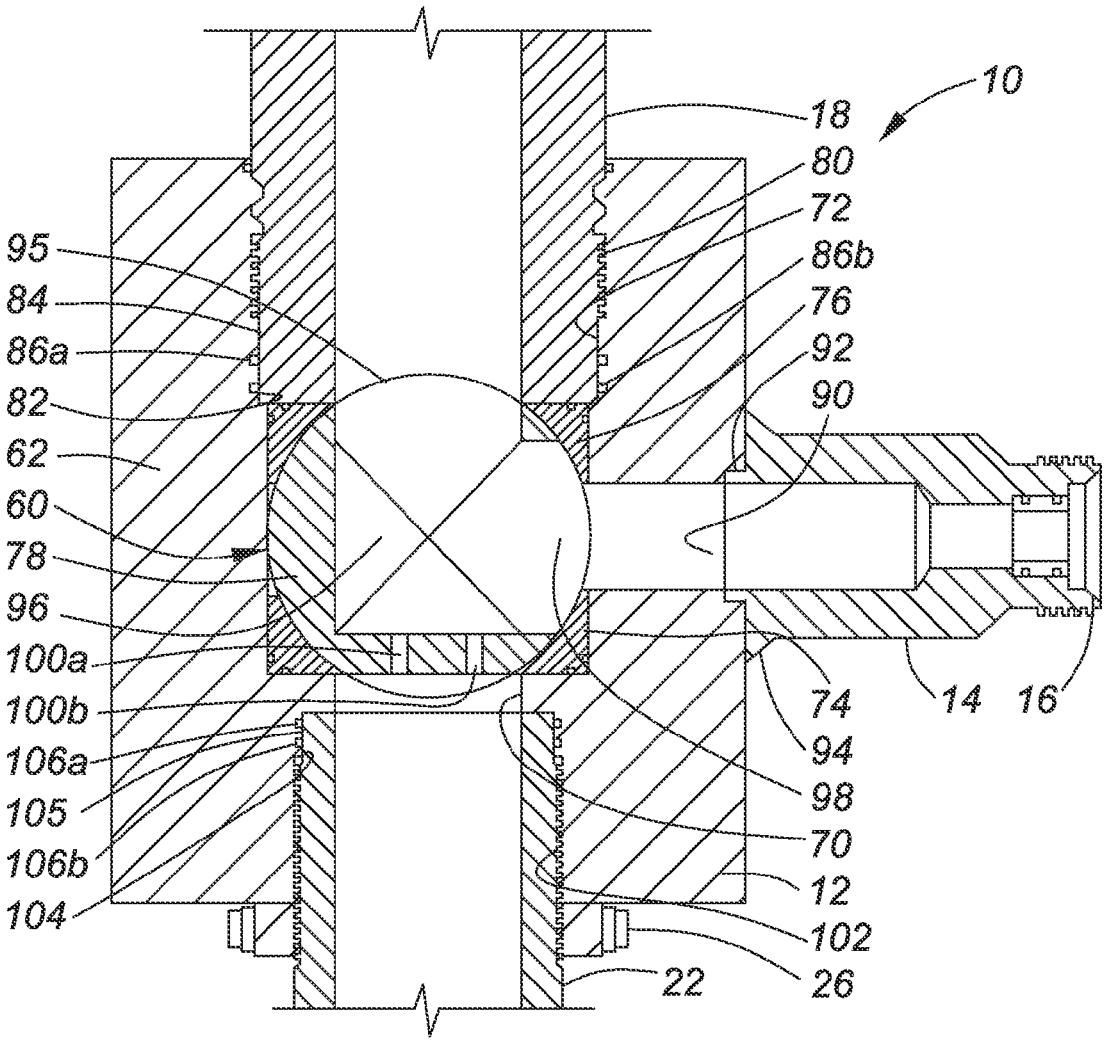
FIG. 5 is a schematic cross-sectional diagram, taken along lines 5-5 shown in FIG. 1, of the ball drop wellhead control apparatus in a ball catch position.

FIG. 5 is a schematic cross-sectional diagram of the control body 12 taken along lines 5-5 shown in FIG. 1 with the ball control mechanism 60 in the ball catch position. The control body 12 is a cylindrical body with a sidewall 62 having a yield strength adequate to withstand frac fluid pressures, e.g. up to at least 15,000 psi. A central passage 70 of the control body 12 is larger than a diameter of a largest frac ball to be dropped into a well. An inlet bore 72 above the central passage 70 receives a lower ball seat 74, a control ball 78, and an upper ball seat 76 of the ball control mechanism 60. The ball control mechanism 60 is locked in the inlet bore 72 by an inner end of the male connector 18, which in this embodiment threadedly engages a box thread 80 in the inlet bore 72. As will be explained below with reference to FIGS. 7 and 8, the control ball 78 is supported by the lower ball seat 74 and the upper ball seat 76 and may be rotated from the ball catch position to the ball release position. An inner end 82 of the male connector 18 is received in a seal bore 84 in a bottom of the inlet bore 72. A pair of O-ring grooves 86*a*, 86*b* in the seal bore 84 respectively retain fluid seals that provide a high pressure fluid seal around the inner end 82 of the male connector 18.

An injection bore 90 intercepts the inlet bore 70 between the lower ball seat 74 and the upper ball seat 76. The injection port 14 is received in an injection port bore 92 that is concentric with the injection bore 90 and welded to the control body 12 at weld 94. The control ball 78 has an inlet port 95, a ball catch pocket 96 and an outlet port 98. Through bores 100*a*, 100*b* provide fluid communication between an interior of the male connector 18 and the female connector 22. This ensures that a ball drop or a ball injector mounted to the control apparatus 10 is exposed to frac fluid pressure, and further ensures that the control ball 78 is free to rotate within the cylindrical cavity since it is pressure balanced on all sides. An outlet bore 102 below the central passage 70 receives an upper end of the female connector 22. An inner end 104 of the female connector 22 is received in a seal bore 105 that has a pair of circumferential grooves 106*a*, 106*b* that support fluid seals to provide a high pressure fluid seal between the female connector 22 and the cylindrical body 12.

As shown in FIG. 5, the ball control mechanism 60 is in the ball catch position so that any ball(s) dropped by a ball drop or a ball injector mounted to the control apparatus 10, 50 is propelled by gravity through the inlet port 95 and into the ball pocket 96. However, the ball cannot drop into a fracturing fluid stream being pumped into the well until an operator operates the control apparatus 10, 50 to move the control ball 78 to the ball release position shown in FIG. 6.

Figure 6:
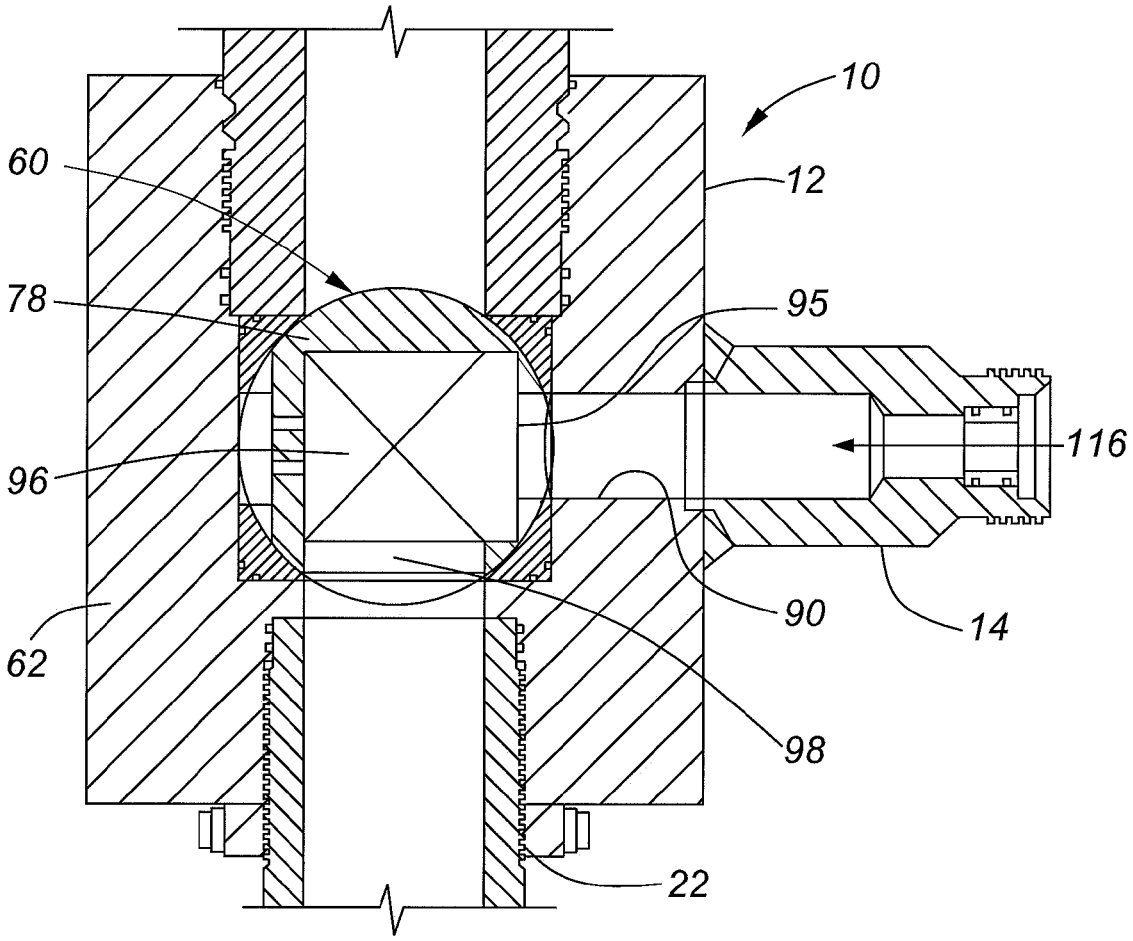
FIG. 6 is a schematic cross-sectional diagram, taken along lines 5-5 shown in FIG. 1, of the ball drop wellhead control apparatus in a ball release position.

FIG. 6 is a schematic cross-sectional diagram of the control apparatus 10 shown in FIG. 1 with the control ball 78 in the ball release position. In this position the control ball 78 has been rotated 90° clockwise by the actuator so that the inlet port 95 and the ball pocket 96 are aligned with the injection bore 90 and the outlet port 98 is aligned with the outlet bore of the female connector 22. In the ball release position, fracturing fluid 116 is optionally pumped for a short period of time through the injection port 14 and the injection bore 90 to drive the frac ball (not shown) downward into the fracturing fluid stream being pumped into the well. The flow of fracturing fluid through the injection port 14 is preferably controlled by an appropriately sized high pressure valve, as will be explained below with reference to FIG. 10. After the fracturing fluid flow through the injection port is stopped, an actuator 222 (see FIG. 10) is operated to move the control ball 78 back to the ball catch position shown in FIG. 5.

Figure 7:
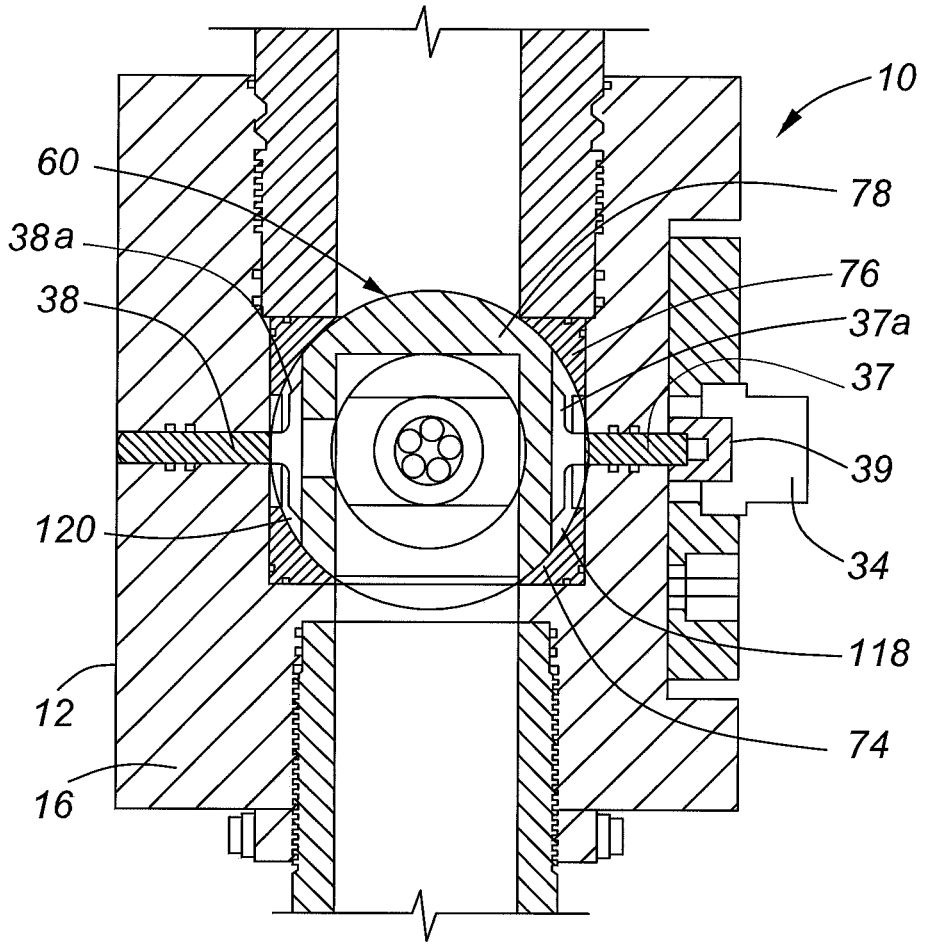
FIG. 7 is a schematic cross-sectional diagram, taken along lines 7-7 shown in FIG. 2, of the ball drop wellhead control apparatus.
Figure 8:
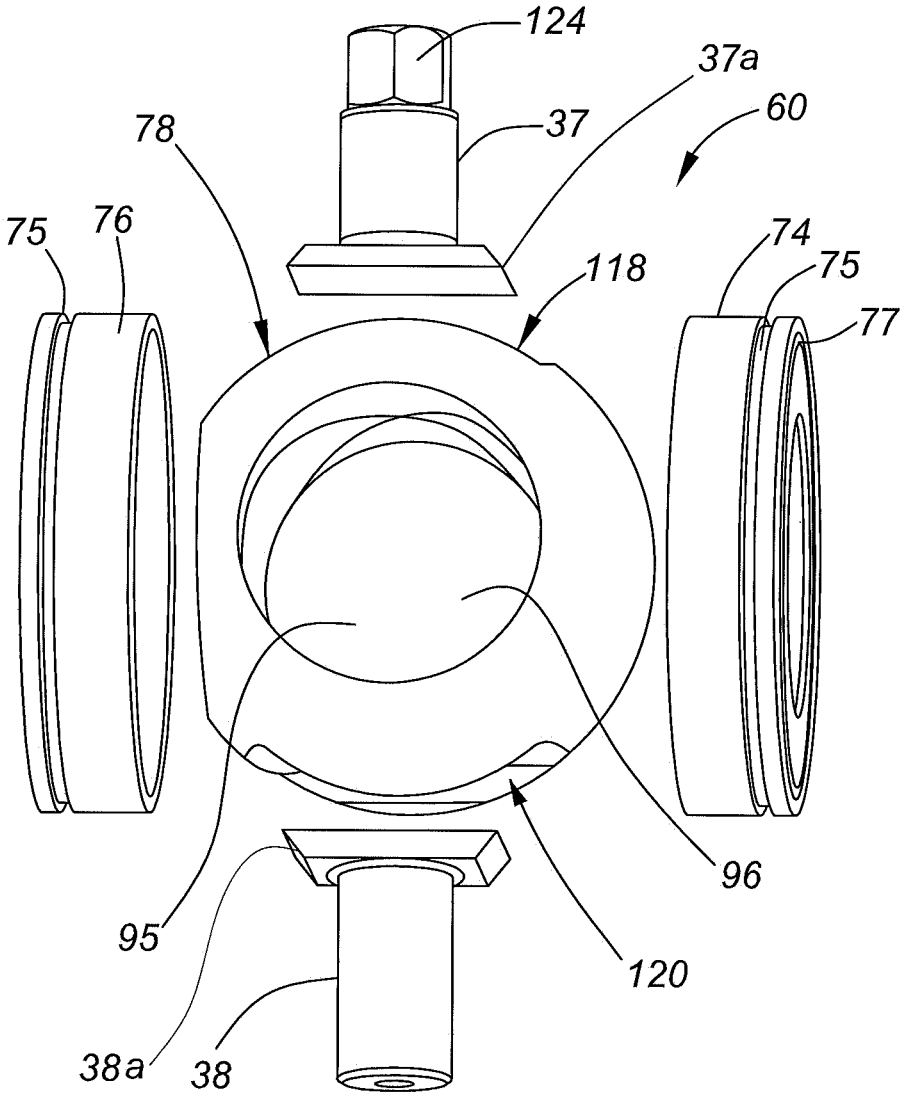
FIG. 8 is an exploded view of a ball control mechanism of the ball drop wellhead control apparatus shown in FIGS. 1-7.
Figure 9:
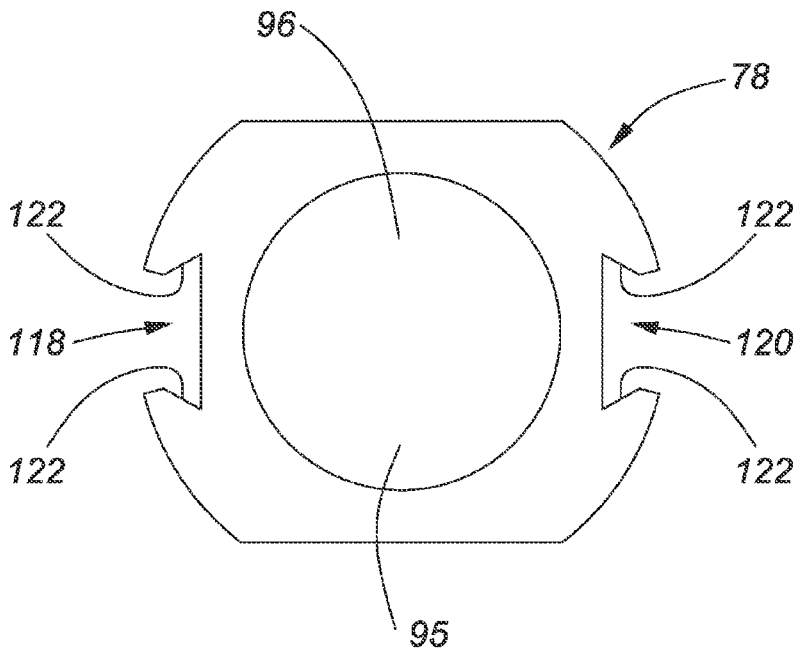
FIG. 9 is a side elevational view of a control ball of the ball control mechanism shown in FIG. 8.

FIG. 7 is a schematic cross-sectional diagram, taken along lines 7-7 shown in FIG. 2, of the ball drop wellhead control apparatus 10 with the control ball 78 in the ball release position shown in FIG. 6. The control ball 78 is supported within the confines of the lower ball seat 74 and the upper ball seat 76 by a ball control stem 37 and the pressure balance stem 38. The ball control stem 37 and the pressure balance stem 38 are T-shaped with respective inner ends 37*a*, 38*a* that are rectangular in end view and have a truncated pyramid shape in side view, as can be seen in FIG. 8. The inner ends 37*a*, 38*a* of the ball control stem 37 and the pressure balance stem 38 are received in respective grooves 118, 120 machined in opposed sides of the control ball 78. The respective grooves 118, 120 have inwardly inclined planar side edges 122 as seen in FIG. 9, which is a side elevational view of the control ball 78. This permits the control ball 78 to float between the lower ball seat and the upper ball seat 76. The ball control stem 37 is connected to the actuator stem 34 by an adaptor 39 that slides over a hex head 124 (see FIG. 8) of the ball control stem 37.

FIG. 8 is an exploded view of the ball control mechanism 60 of the control apparatus 10, 50 shown in FIGS. 1-7. In this view, the ball control stem 37 is shown removed from the groove 118 in the control ball 78. The pressure balance stem 38 is likewise shown removed from the groove 120 in the control ball 78. It should also be noted that in one embodiment the lower ball seat 74 and upper ball seat 76 respectively have a fluid seal groove 75, 77 to inhibit a migration of fracturing fluid into threaded connections of the control apparatus 10.

FIG. 9 is a side elevational view of the control ball 78 of the ball control apparatus 10, 50 shown in FIG. 8. The inwardly inclined planar side surfaces 122 of the respective grooves 118, 120 can be seen.

FIG. 10 is a schematic diagram of the control apparatus 10 shown in FIG. 1 mounted in an exemplary frac stack 200. This frac stack 200 is mounted to a wellhead 202. The frac stack 200 includes a cross-flow tee 204, a high pressure valve 206, and adapter 208, and a frac head 210 to which a plurality of frac irons (not shown) are connected in a manner well known in the art. An adapter 212, a Bowen union for example, is used to connect the control apparatus 10 to the top of the frac head 210. A high pressure valve 214 is connected directly or indirectly to the injection port 14 of the control body 12 to control a flow of fracturing fluid supplied by a frac iron 216 connected to a frac manifold (not shown) in a manner well known in the art. A ball drop or a ball injector 220 is mounted to a top of the control apparatus 10. The ball drop or ball injector 220 may be any one of the frac ball drops or frac ball injectors known in the art.

As explained above, in use a ball is dropped from the ball drop or ball injector 220 at an appropriate time while the control ball 78 of the control apparatus 10 is in the ball catch position shown in FIG. 5. Most ball drops and ball injectors have a mechanism for determining which ball(s) were dropped. Once the ball drop or ball injector operator has verified that the correct frac ball, and only the correct frac ball, was dropped an actuator 222 is operated to move the control ball 78 from the ball catch position shown in FIG. 5 to the ball release position shown in FIG. 6. If the wrong ball is dropped, or one or more extra balls are dropped due to a mechanical malfunction or operator error, then the frac job must be stopped, pressure released and the control apparatus 10, 50 must be removed and the ball pocket 96 emptied. Everything can then be reassembled and the fracturing operation may be resumed. Consequently, recovery is relatively simple and inexpensive.

The control apparatus 10, 50 also provides another advantage. It permits frac balls having a diameter less than an internal diameter of the injection port 14 to be injected manually if required. As is well understood in the art, frac balls with a diameter of less than 2" are more fragile and consequently more likely to shatter when they are driven into the seat of a ball-actuated frac sleeve. If a pumping crew does not see the fracturing fluid pressure spike they expect after a small frac ball is pumped down, they may request another ball of the same diameter be dropped. This cannot be accomplished by most ball drops or ball injectors. Consequently, the job must be stopped, pressure released, disconnections made and time taken to load the requested frac ball. This request can be readily fulfilled without stopping the frac job using the control apparatus 10, 50 by closing the frac line 216 and manually inserting the requested frac ball using an auxiliary valve (not shown). The requested frac ball is then pumped through the high pressure valve 214 while the control ball 100 is in the ball release position shown in FIG. 6.

The actuator 222 can be any control mechanism, including a hydraulic actuator, a stepper motor, a hydraulic motor, or any other power source capable of reliably moving the control ball from the ball catch position shown in FIG. 5 to the ball release position shown in FIG. 6, and back again.

The scope of the invention is therefore intended to be limited solely by the scope of the appended claims.

We claim:

1. A ball drop wellhead control apparatus, comprising:

a control body having a central passage;

a control ball housed by the control body and obstructing the central passage, the control ball having an inlet port aligned with the central passage in a ball catch position, a ball pocket and an outlet port oriented at a right angle with respect to the inlet port, the control ball inhibiting any frac ball in the ball pocket from being released from the ball drop wellhead control apparatus until the control ball is rotated to a ball release position in which the outlet port is aligned with the central passage, the control ball further comprising at least one through bore that provides fluid communication through the control ball, the at least one through bore being located in a bottom of the ball pocket, and the at least one through bore having a smaller internal diameter than an outer diameter of a smallest frac ball to be controlled by the ball drop wellhead control apparatus.

2. The ball drop wellhead control apparatus as claimed in claim 1 further comprising an injection port in a sidewall of the control body, the injection port being aligned with the inlet port when the control ball is in the ball release position.

3. The ball drop wellhead control apparatus as claimed in claim 2, wherein the injection port is aligned with the outlet port when the control ball is in the ball catch position.

4. The ball drop wellhead control apparatus as claimed in claim 2, further comprising an injection adapter connected to the injection port to permit a frac iron to be connected to the injection port to permit frac fluid to be pumped through the inlet port, the ball pocket and out through the outlet port when the control ball is in the ball release position.

5. The ball drop wellhead control apparatus as claimed in claim 1, wherein the control ball has a slot in opposed sides thereof, the respective slots receiving respective ends of a control stem and a pressure balance stem.

6. The ball drop wellhead control apparatus as claimed in claim 5, further comprising an actuator connected to the control stem to move the control ball from the ball catch position to the ball release position.

7. The ball drop wellhead control apparatus as claimed in claim 1, further comprising a lower ball seat and an upper ball seat that rotatably support the control ball.

8. The ball drop wellhead control apparatus as claimed in claim 7, wherein the upper ball seat and the lower ball seat are respectively received on opposite sides of the control ball in an inlet bore of the control body.

9. A ball drop wellhead control apparatus, comprising:

a control body adapted to be mounted below a frac ball drop or a frac ball injector so that any frac balls released from the frac ball drop or the frac ball injector enter a central passage of the control body before the frac balls can enter a frac fluid stream being pumped into a well; and a control ball housed by the control body and obstructing the central passage of the control body, the control ball comprising an inlet port that is aligned with the central passage when the control ball is in the ball catch position at least one through bore that provides the fluid communication between the fluid stream and the frac ball drop or the frac ball injector, the at least one through bore having a smaller internal diameter than an outer diameter of a smallest frac ball to be dropped by the frac ball drop or the frac ball injector, and an outlet port oriented at a right angle with respect to the inlet port, the outlet port being aligned with the central passage when the control ball is in the ball release position, the control ball providing fluid communication between the fluid stream and the frac ball drop or the frac ball injector when the control ball is in a ball catch position, while inhibiting any frac ball dropped from the frac ball drop or the frac ball injector from being released from the central passage of the control body until the control ball is moved to a ball release position.

10. The ball drop wellhead control apparatus as claimed in claim 9, further comprising an injection port in a sidewall of the control body, the injection port being aligned with the outlet port when the control ball is in the ball catch position, and aligned with the inlet port when the control ball is in the ball release position.

11. The ball drop wellhead control apparatus as claimed in claim 10, further comprising an injection adapter connected to the injection port to permit frac fluid to be pumped through the inlet port, the ball pocket and the outlet port when the control ball is in the ball release position.

12. The ball drop wellhead control apparatus as claimed in claim 9, wherein the control ball further comprises slots on opposite sides thereof, the respective slots having inwardly inclined planar side surfaces.

13. The ball drop wellhead control apparatus as claimed in claim 12, wherein one of the slots receives an inner end of an actuator stem and the other slot receives an inner end of a pressure balance stem.

14. The ball drop wellhead control apparatus as claimed in claim 9, further comprising a lower ball seat and an upper ball seat received in an inlet bore of the control body, the lower ball seat and the upper ball seat surrounding and supporting the control ball.

15. A ball drop wellhead control apparatus, comprising:

a control body adapted to be mounted in a frac stack below one of a frac ball drop and a frac ball injector such that all frac balls released from the one of the frac ball drop and the frac ball injector enter an inlet bore of the control body;

a control ball housed by the control body and obstructing a central passage of the control body, the control ball having an inlet port aligned with the central passage when the control ball is in a ball catch position and an outlet port that is oriented at a right angle with respect to the inlet port, the outlet port being aligned with the central passage when the control ball is in a ball release position; and an actuator stem connected to the control ball, the actuator stem being adapted to move the control ball from the ball catch position to the ball release position.

16. The ball drop wellhead control apparatus as claimed in claim 15, further comprising a lower ball seat and an upper ball seat, the lower ball seat and the upper ball seat supporting the control ball for rotation by the actuator stem from the ball catch position to the ball release position.

* * * * *